US007670113B1

(12) United States Patent
Liang

(10) Patent No.: US 7,670,113 B1
(45) Date of Patent: Mar. 2, 2010

(54) TURBINE AIRFOIL WITH SERPENTINE TRAILING EDGE COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 531 days.

(21) Appl. No.: 11/809,323

(22) Filed: May 31, 2007

(51) Int. Cl.
*F01D 5/18* (2006.01)

(52) U.S. Cl. ..... 416/97 R; 416/96 R

(58) Field of Classification Search ..... 415/115, 415/116; 416/96 R, 97 R
See application file for complete search history.

(56) References Cited

U.S. PATENT DOCUMENTS 4,684,322 A * 8/1987 Clifford et al. ..... 416/95
5,387,085 A 2/1995 Thomas, Jr. et al.
5,975,851 A 11/1999 Liang
6,099,252 A 8/2000 Manning et al.
6,139,269 A 10/2000 Liang
6,174,134 B1 1/2001 Lee et al.
6,290,463 B1 9/2001 Fargher et al.
6,481,967 B2 11/2002 Tomita et al.
6,491,496 B2 12/2002 Starkweather
6,634,858 B2 10/2003 Roeloffs et al.
6,832,889 B1 12/2004 Lee et al.
6,960,060 B2 11/2005 Lee
6,988,872 B2 1/2006 Soechting et al.
7,008,179 B2 3/2006 Rinck et al.
7,137,779 B2 11/2006 Liang
2006/0222493 A1 * 10/2006 Liang ..... 416/97 R

* cited by examiner

*Primary Examiner*—Edward Look
*Assistant Examiner*—Dwayne J White
(74) *Attorney, Agent, or Firm*—John Ryznic

(57) ABSTRACT

A turbine blade for use in a gas turbine engine, the blade having a trailing edge cooling circuit that includes a series of multiple pass serpentine flow cooling passages arranged along the trailing edge region of the blade in series such that the cooling air flowing through a lower serpentine passage will then flow into the serpentine passage located above in order to greatly increase the cooling air flow path through the trailing edge region. The last leg of each serpentine flow passage includes a row of cooling air exit holes to discharge cooling air from the serpentine passage out through the trailing edge of the blade. The rotation of the rotor blade acts to increase the cooling air pressure as the cooling air passes through the series of serpentine passages. Because the cooling air passes through the lower reaches of the rotor blade first, the lower reaches receives the most cooling while the upper reaches receives heated cooling air. Because the upper reaches of the blade require less cooling to maintain the metal temperature within limits, the series serpentine cooling passages of the present invention provides for a higher level of cooling while using minimal amounts of cooling air.

15 Claims, 2 Drawing Sheets

TURBINE AIRFOIL WITH SERPENTINE TRAILING EDGE COOLING CIRCUIT

CROSS-REFERENCE TO RELATED APPLICATIONS

This application is related to U.S. patent application Ser. No. 11/805,735 filed on May 24, 2007 by George Liang and entitled TURBINE AIRFOIL WITH A NEAR WALL MINI SERPENTINE COOLING CIRCUIT.

BACKGROUND OF THE INVENTION

1. Field of the Invention

The present invention relates generally to fluid reaction surfaces, and more specifically to turbine rotor blade with a trailing edge cooling circuit.

2. Description of the Related Art Including Information Disclosed Under 37 CFR 1.97 and 1.98

A gas turbine engine includes a turbine section with multiple stages of stator vanes and rotor blades that are exposed to a high temperature gas flow produced in the combustor section by burning a fuel. The engine efficiency can be increased by passing a higher gas flow temperature into the turbine section. The material properties of the first stage stator vanes and rotor blades establish a maximum temperature for the turbine section.

These high temperature turbine airfoils are provided with complex internal cooling circuit to provide cooling for the airfoils to extend the operating temperature of these airfoils beyond the material characteristic temperature limits. Hot spots can appear on the airfoils due to uneven exposure to the hot gas flow through the turbine and to uneven cooling provided by the convection and film cooling circuits. Especially in an industrial gas turbine—where engine part life is a major design factor—a large rotor blade will produce high levels of stress in the lower portions of the blade closer to the platform. Higher amounts of cooling air required for the portions of the blade that would produce high levels of creep. In other words, more cooling is required in the lower sections of the rotor blade because of the high stress levels that occur due to the mass of the rotating blade. The blade section above the root will tend to pull on the blade section near the root due to centrifugal forces that develop during rotation of the blade. Because the rotor blade is exposed to an extremely high temperature, and that the blade material becomes weaker as the temperature of the metal rises, without adequate cooling at the lower section the rotor blade could have problems with excessive creep. This will shorten the life of the blade and require premature engine over hall to fix damaged blades.

Prior art turbine blade have cooling holes drilled into the trailing edge region of the blade that connect to an internal cooling air supply channel formed into the turbine blade. Cooling air flows upward in the cooling air supply passage and bleeds off into the row of cooling holes to provide cooling for the trailing edge region. This single pass axial flow cooling circuit of the prior art design provides very little cooling for the trailing edge region because the flow path for the cooling air is very short. U.S. Pat. No. 5,387,085 issued to Thomas, Jr et al on Feb. 7, 1995 and entitled TURBINE BLADE COMPOSITE COOLING CIRCUIT discloses this blade trailing edge cooling circuit. Also, the lower reaches of the blade have low levels of cooling while the upper reaches (near the tip) have too much cooling. Creep is a major problem in the lower reaches of the blade and decreases in the direction of the blade tip.

U.S. Pat. No. 6,491,496 B2 issued to Starkweather on Dec. 10, 2002 and entitled TURBINE AIRFOIL WITH METERING PLATES FOR REFRESHER HOLES shows a rotor blade with the cooling air supply channel following a serpentine flow path before the cooling air is bled off into the trailing edge cooling holes. The cooling air supply path to the trailing edge cooling holes is longer and therefore the cooling air gains more heat prior to discharging out through the exit holes along the trailing edge.

Another prior art device, U.S. Pat. No. 6,139,269 issued to Liang on Oct. 31, 2000 and entitled TURBINE BLADE WITH MULTI-PASS COOLING AND COOLING AIR ADDITION shows the trailing edge region being cooled by a circuit that used multiple impingement cooling in the trailing edge region. This design improves the trailing edge region cooling capability over the above cited prior art cooling circuits.

U.S. Pat. No. 6,099,252 issued to Manning et al on Aug. 8, 2000 and entitled AXIAL SERPENTINE COOLED AIRFOIL discloses a turbine blade with the trailing edge region cooled by an axial serpentine cooling circuit having a plurality of serpentine circuits stacked in a radial row along the airfoil trailing edge. These stacked serpentine circuits form a plurality of parallel cooling circuits connected to the cooling supply channel. The flow path of the cooling air through the trailing edge region is increased over the above cited prior art circuits and thus the cooling ability of the Manning et al circuit is increased.

It is therefore an object of the present invention to provide for a cooling circuit in an airfoil trailing edge region that will reduce the metal temperature and thus reduce the cooling flow requirement over the above cited prior art trailing edge cooling circuits.

BRIEF SUMMARY OF THE INVENTION

A turbine blade for use in a gas turbine engine, the blade having a trailing edge cooling circuit that includes a series of multiple pass serpentine flow cooling passages arranged along the trailing edge region of the blade in series such that the cooling air flowing through a lower serpentine passage will then flow into the serpentine passage located above in order to greatly increase the cooling air flow path through the trailing edge region. The last leg of each serpentine flow passage includes a row of cooling air exit holes to discharge cooling air from the serpentine passage out through the trailing edge of the blade. The rotation of the rotor blade acts to increase the cooling air pressure as the cooling air passes through the series of serpentine passages. Because the cooling air passes through the lower reaches of the rotor blade first, the lower reaches receives the most cooling while the upper reaches receives heated cooling air. Because the upper reaches of the blade require less cooling to maintain the metal temperature within limits, the series serpentine cooling passages of the present invention provides for a higher level of cooling while using minimal amounts of cooling air.

DETAILED DESCRIPTION OF THE INVENTION

The present invention is a turbine rotor blade with a trailing edge cooling circuit to provide high levels of cooling to the trailing edge while minimizing the amount of cooling air required. The trailing edge cooling circuit of the present invention could also be used to provide cooling to the leading edge of the rotor blade, or to both edges of a stator vane.

Figure 1:
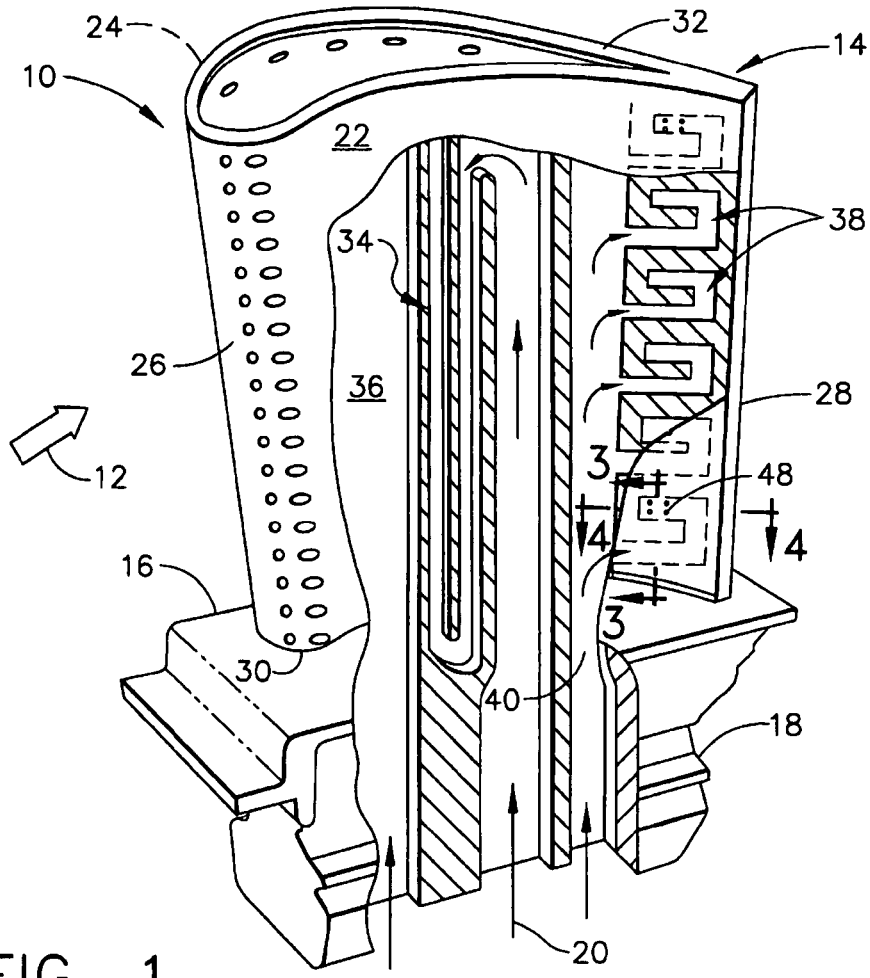
FIG. 1 prior art
FIGS. 1 and 2 show a turbine blade trailing edge cooling circuit of the prior art.
Figure 2:
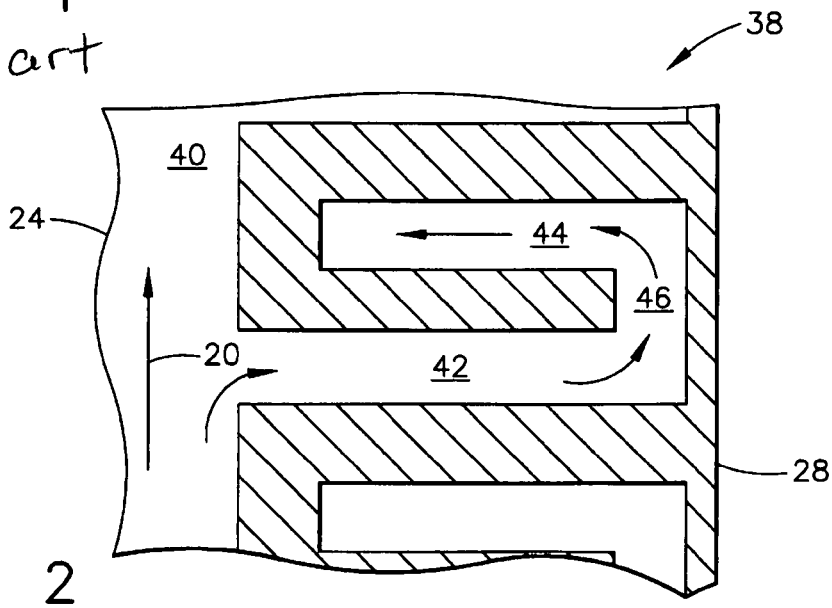
FIG. 2 prior art
Figure 3:
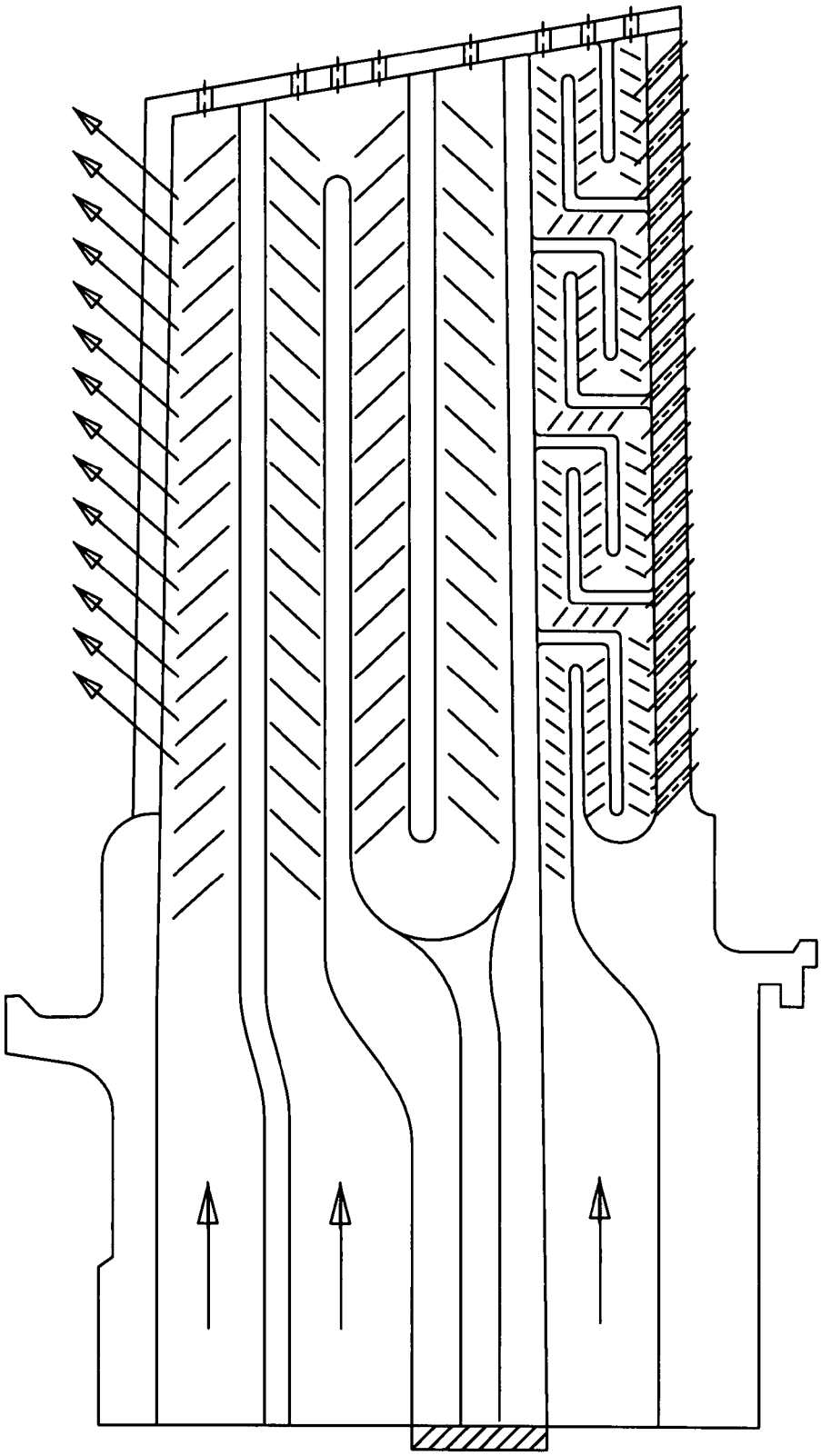
FIG. 3 shows a cross section view of the trailing edge cooling circuit of the present invention.

FIG. 3 shows a cross section view of the internal cooling circuit of the turbine blade of the present invention. a leading edge cooling supply channel is located along the leading edge region of the blade and supplies pressurized cooling air to the film cooling holes positioned along the leading edge of the blade, such as those used in a showerhead arrangement. A 3-pass serpentine flow cooling circuit is located immediately downstream in the hot gas flow direction from the leading edge cooling air supply channel to provide convection cooling for the blade mid-chord section. A cooling air supply channel located in the blade root is located downstream from the mid-chord serpentine flow circuit, and supplies cooling air to the series serpentine flow cooling circuit of the present invention.

In the present invention shown in FIG. 3, the series of serpentine cooling passages are 3-pass serpentine flow passages in which the first up-pass channel is located adjacent to the last leg of the mid-chord serpentine flow circuit, the second leg or first down-pass channel is located immediately downstream there-from, and the third and last leg or second up-pass channel is located along the trailing edge of the airfoil. A row of exit cooling holes are connected to the last leg or second up-pass channel of the serpentine circuit to discharge cooling air out from the airfoil.

In the embodiment of FIG. 3, a second 3-pass serpentine flow cooling passage is located above the first 3-pass serpentine passage and connected in series with it such that cooling air from the last leg of the first 3-pass serpentine passage flows into the first leg of the second 3-pass serpentine passage located directly above. This series of cooling air flow continues into the third 3-pass serpentine passage and then into the fourth and last 3-pass serpentine passage as seen in FIG. 3. Each of the last legs in the 3-pass serpentine passages includes a row of exit cooling holes to discharge cooling air out from the airfoil. Trip strips are included in the serpentine passages to promote heat transfer within the cooling circuit.

Because the rotor blade of FIG. 3 with the series of 3-pass serpentine passages is rotating during operation, the cooling air flow is aided by the centrifugal force that develops so that the pressure of the cooling air in the upper reaches of the passages in high enough to flow through the exit cooling holes and into the next 3-pass serpentine passage. The cooling air flows through the series of 3-pass serpentine passages from the supply channel in the root and all along the entire trailing edge region before being discharged out the exit cooling holes or the blade tip cooling holes. The cooling flow path is thus stretched out to almost three times the airfoil length along the trailing edge. Much more heat is picked up by the passing cooling air than in any of the other cited prior art cooling circuits.

The multiple pass serpentine passages used in the present invention can be 3-pass or 5-pass serpentine flow passages. Also, the number of serpentine flow passages spaced along the trailing edge can be two, three, four (as shown in the FIG. 3 embodiment), or even more if the space permits. Each individual serpentine module can be designed based on the airfoil local external heat load to achieve a desired local metal temperature.

Because the fresh cooling air passes through the cooling circuit from the blade root to the tip, the fresh cooling air provides cooling for the blade root section first and therefore enhances the blade trailing edge HCF (high cycle fatigue) capability. The cooling air increases in temperature in the series serpentine flow cooling channel as if flows outward toward the blade tip and therefore induces hotter metal temperature at the upper blade span. However, the pull stress at the blade upper span is low and the allowable blade metal temperature is high. Thus, a balanced thermal design is achieved by the use of the series serpentine flow cooling channels of the present invention.

I claim the following:

1. A turbine airfoil for use in a gas turbine engine, the airfoil comprising:

a leading edge and a trailing edge;

a pressure side and a suction side extending between the leading and trailing edges;

a first multiple pass serpentine flow cooling passage located along the trailing edge of the airfoil;

a second multiple pass serpentine flow cooling passage located along the trailing edge of the airfoil and above the first multiple pass serpentine flow cooling passage;

a cooling air supply channel connected to the first multiple pass serpentine flow cooling passage to supply cooling air thereto; and, the second multiple pass serpentine flow cooling passage being connected in series with the first multiple pass serpentine flow cooling passage such that cooling air flows from the first multiple pass serpentine flow cooling passage into the second multiple pass serpentine flow cooling passage.

2. The turbine airfoil of claim 1, and further comprising:

the last leg of the first and second multiple pass serpentine flow cooling passages is connected to a row of exit cooling holes.

3. The turbine airfoil of claim 1, and further comprising:

the legs of the first and second multiple pass serpentine flow cooling passages are radial flow channels.

4. The turbine airfoil of claim 1, and further comprising:

an axial flow channel connects the last leg of the first multiple pass serpentine flow cooling passage with the first leg of the second multiple pass serpentine flow cooling passage.

5. The turbine airfoil of claim 1, and further comprising:

the multiple pass serpentine flow cooling passages are 3-pass serpentine flow passages.

6. The turbine airfoil of claim 1, and further comprising:

the multiple pass serpentine flow cooling passages are 5-pass serpentine flow passages.

7. The turbine airfoil of claim 1, and further comprising:

a third multiple pass serpentine flow cooling passage located along the trailing edge of the airfoil and above the second multiple pass serpentine flow cooling passage;

cooling air channel means to connect the last leg of the second multiple pass serpentine flow cooling passage to the first leg of the third multiple pass serpentine flow cooling passage; and, airfoil tip exit cooling holes connected to the third multiple pass serpentine flow cooling passage to discharge cooling air from the serpentine passage out from the airfoil tip.

8. The turbine airfoil of claim 7, and further comprising:

the last leg of the third multiple pass serpentine flow cooling passages is connected to a row of exit cooling holes.

9. The turbine airfoil of claim 1, and further comprising:

trip strips along the serpentine flow cooling passages to promote heat transfer to the cooling air flow.

10. The turbine airfoil of claim 1, and further comprising:

the turbine airfoil is a rotor blade.

11. The turbine airfoil of claim 1, and further comprising:

a plurality of multiple pass serpentine flow cooling passages arranged along the trailing edge from the platform to the tip and connected in series such that the cooling air that flows into the outer serpentine flow cooling passages flows within the inner serpentine flow cooling passages first.

12. The turbine airfoil of claim 11, and further comprising:

the legs of the serpentine flow cooling passages are radial extending legs.

13. The turbine airfoil of claim 12, and further comprising:

the last legs of the serpentine flow cooling passages are connected to exit cooling holes to discharge cooling air from the respective last leg and out from the airfoil.

14. The turbine airfoil of claim 13, and further comprising:

the last multiple pass serpentine flow cooling passage is located at the airfoil tip; and, a plurality of exit cooling holes at the airfoil tip connected to the last serpentine flow cooling passage to discharge cooling air out through the airfoil tip.

15. The turbine airfoil of claim 12, and further comprising:

the series of multiple pass serpentine flow cooling passages are connected together by an axial flow cooling channel.

* * * * *